US007044405B2

(12) United States Patent
Kawazoe et al.

(10) Patent No.: US 7,044,405 B2
(45) Date of Patent: May 16, 2006

(54) FUEL INJECTORS

(75) Inventors: Hiroshi Kawazoe, Aichi-ken (JP); Toshiro Makimura, Aichi-ken (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 10/771,158

(22) Filed: Feb. 4, 2004

(65) Prior Publication Data

US 2004/0206833 A1 Oct. 21, 2004

(30) Foreign Application Priority Data

Feb. 6, 2003 (JP) ..... 2003-068897

(51) Int. Cl.
*F02M 61/00* (2006.01)

(52) U.S. Cl. ..... 239/533.12; 239/585.1; 239/499; 239/518

(58) Field of Classification Search ..... 239/533.3, 239/533.12, 585.1, 585.3, 499, 500, 518
See application file for complete search history.

(56) References Cited

U.S. PATENT DOCUMENTS

| | | | | |
|---|---|---|---|---|
| 5,054,691 | A * | 10/1991 | Huang et al. | 239/585.3 |
| 5,314,122 | A * | 5/1994 | Winter | 239/585.1 |
| 6,059,205 | A * | 5/2000 | Ricco | 239/585.1 |

FOREIGN PATENT DOCUMENTS

| | | |
|---|---|---|
| JP | 861152 | 3/1996 |
| JP | 2000240525 | 9/2000 |
| JP | 2000249022 | 9/2000 |

* cited by examiner

*Primary Examiner*—Christopher Kim
(74) *Attorney, Agent, or Firm*—Dennison, Schultz, Dougherty & MacDonald

(57) ABSTRACT

It is, accordingly, an object of the present teachings to provide fuel injectors that can prevent leakage of noise, which is caused by contact of the valve with the valve seat, to the outside of the fuel injector. a representative injector may comprise a fuel passage, a valve, a valve seat, a jet opening and a jet opening downstream channel. The valve is disposed on the fuel passage and the valve seat receives the valve. The jet opening is formed in the valve seat and through which fuel is exhausted. The jet opening may be opened when the valve is moved apart from the valve seat. The jet opening downstream channel extends downstream from the jet opening through the valve seat and communicates the jet opening to the outside. The diameter of the jet opening downstream channel may be arranged and adapted such that the valve seat has a wall thickness to prevent leakage of noise to the outside through the valve seat. Because the diameter of the jet opening downstream channel is designed to be smaller and the wall thickness of the valve seat is designed to be greater, the representative injector can effectively prevent leakage of noise to the outside through the valve seat.

3 Claims, 1 Drawing Sheet

FUEL INJECTORS

BACKGROUND OF THE INVENTION

1. Field of the Invention

The present invention relates to fuel injectors utilized in an internal combustion engines and more particularly, to fuel injectors which can reduce valve noise during the operation.

2. Description of the Related Art

An example of a known fuel injector for an internal combustion engine is disclosed in Japanese Laid-Open Patent Publication No. 2000-240525 and is reproduced in FIG. 2. FIG. 2 shows a sectional view of a fuel injector 7 for an internal combustion engine. The fuel injector 7 is designed to lift an armature, which forms a valve 6, by excitation of a coil and exhaust (inject) fuel through a jet opening 5*a*. Further, the fuel injector 7 has a jet opening downstream channel 5*b* that extends downstream from the jet opening 5*a* through a valve seat 5. The fuel injector 7 is configured such that fuel exhausted from the jet opening 5*a* can be diffused as much as possible into the engine and atomized.

However, because the jet opening downstream channel 5*b* is provided within the valve seat 5, the wall thickness B of the valve seat 5 on the downstream side of the jet opening 5*a* becomes relatively small. Therefore, noise which is caused by contact of the valve 6 with the valve seat 5 is transmitted through the thin portion of the valve seat 5 on the downstream side of the jet opening 5*a* and leaks to the outside of the fuel injector 7.

SUMMARY OF THE INVENTION

It is, accordingly, an object of the present teachings to provide fuel injectors that can prevent leakage of noise, which is caused by contact of the valve with the valve seat, to the outside of the fuel injector.

According to the present invention, a representative injector may comprise a fuel passage, a valve, a valve seat, a jet opening and a jet opening downstream channel. The valve is disposed on the fuel passage and the valve seat receives the valve. The jet opening is formed in the valve seat and through which fuel is exhausted. The jet opening may be opened when the valve is moved apart from the valve seat. When the jet opening is opened, fuel can be exhausted (injected) from the jet opening. The jet opening downstream channel extends downstream from the jet opening through the valve seat and communicates the jet opening to the outside. Thus, fuel exhausted at the jet opening can be injected to the outside via the jet opening downstream channel.

The diameter of the jet opening downstream channel may be arranged and adapted such that the valve seat has a wall thickness to prevent leakage of noise to the outside through the valve seat. Such noise is typically caused by contact of the valve with the valve seat.

According to the present invention, because the diameter of the jet opening downstream channel is designed to be smaller and accordingly, the wall thickness of the valve seat is designed to be greater, the representative injector can effectively prevent leakage of noise to the outside through the valve seat.

Other objects, features and advantages of the present invention will be readily understood after reading the following detailed description together with the accompanying drawings and the claims.

BRIEF DESCRIPTION OF THE DRAWINGS

FIG. 1(*b*) is a sectional view of a valve seat of a fuel injector according to the second representative embodiment of the invention;

FIG. 1(*c*) is a sectional view of a valve seat of a fuel injector according to the third representative embodiment of the invention.

DETAILED DESCRIPTION OF THE INVENTION

Figure 1A:
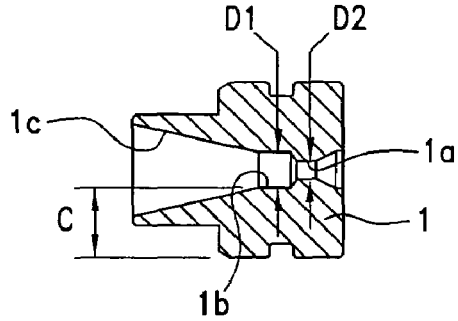
FIG. 1(*a*) is a sectional view of a valve seat of a fuel injector according to the first representative embodiment of the present invention.

As one aspect of the present teachings, the diameter of the jet opening downstream channel of the representative fuel injector may be designed so as to ensure the diffusability of the fuel exhausted from the jet opening, as well as preventing leakage of noise to the outside through the valve seat.

Especially, the jet opening downstream channel may preferably have a region in which its diameter is substantially double the diameter of the jet opening. The diameter of the jet opening downstream channel may have substantially double the diameter of the jet opening at least in a region right below the jet opening.

Preferably, the length of the jet opening downstream channel along its longitudinal axis may be substantially the same as or larger than the diameter of the jet opening downstream channel. As a result, the leakage of noise to the outside can be more effectively prevented.

Further, as another aspect of the present invention, the representative fuel injector may preferably comprise a first channel and a second channel within the jet opening downstream channel. The first channel may be formed in the region right below the jet opening so as to have a diameter substantially double the diameter of the jet opening. On the other hand, the second channel may be continuously and smoothly connected to the first channel in the region below the first channel. The second channel may be conically enlarged away from the jet opening.

Otherwise, the diameter of the jet opening downstream channel may be substantially double the diameter of the jet opening over its entire region.

Otherwise, the representative fuel injector may preferably comprise a first channel and a second channel within the jet opening downstream channel. The first channel may be formed in the region right below the jet opening so as to have a diameter substantially double the diameter of the jet opening. Especially, the first channel may preferably be arranged and adapted to have a diameter substantially double the diameter of the jet opening such that the valve seat has a wall thickness to prevent leakage of noise to the outside through the valve seat. On the other hand, the second channel may have a diameter larger than the diameter of the first channel over the entire region of the second channel. As a result, the second channel can ensure satisfactory diffusion of fuel exhausted from the jet opening. The first channel and the second channel may preferably be continuously and smoothly connected to each other.

Each of the additional features and method steps disclosed above and below may be utilized separately or in conjunction with other features and method steps to provide improved fuel injector and method for using such fuel injectors and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

A first representative embodiment will now be described with reference to FIG. 1(*a*). As premise, with respect to features of the representative embodiment having substantially the same construction with features utilized within the known fuel injector, detailed description is made in reference to FIG. 2 for the sake of convenience.

Figure 1B:
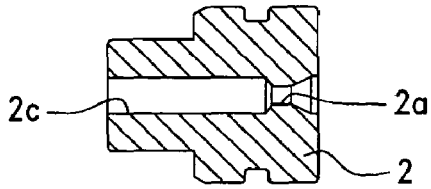
Figure 1C:
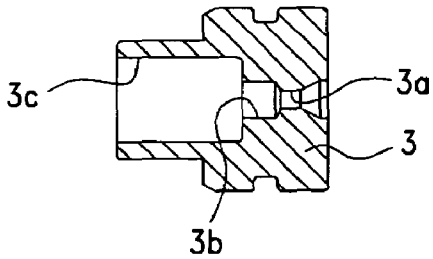
Figure 2:
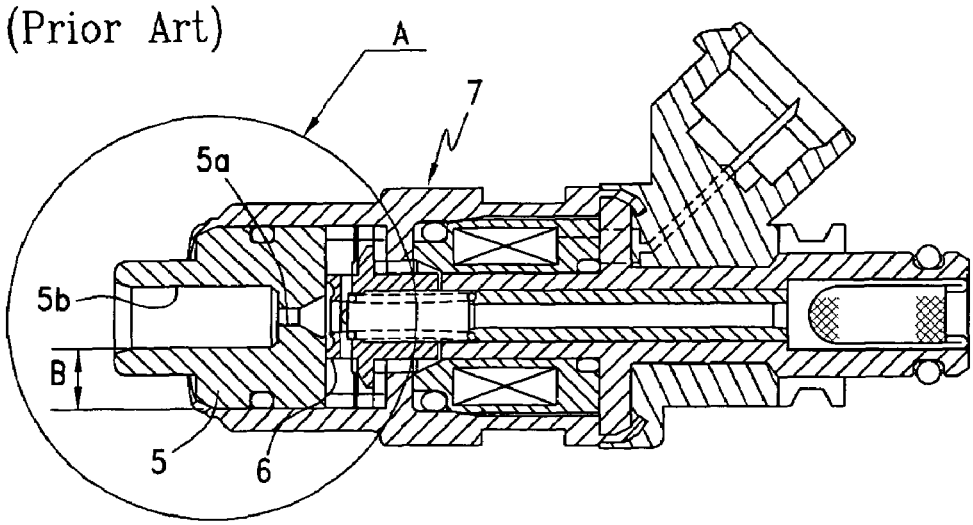
FIG. 2 (Prior Art)
FIG. 2 is a sectional view of a known fuel injector.

First representative embodiment is now described in reference to FIG. 1(*a*). FIG. 1(*a*) is a sectional view of a valve seat 2 used in a representative fuel injector as the first representative embodiment. In FIG. 1(*a*), a jet opening downstream channel is defined by a first channel 1*b* and a second channel 1*c*. The first channel 1*b* is formed in a region right below a jet opening 1*a* of a valve seat 1 and has a diameter D1. The diameter D1 of the first channel 1*b* is smaller than that of the jet opening downstream channel 5*b* of the known injector as shown in FIG. 2. If the diameter of the first channel 1*b* has a larger diameter such as a known fuel injector, the wall thickness C of the valve seat around the first channel will become smaller. Such a thinner wall can not more satisfactorily muffle the noise which is caused by contact of the valve with the valve seat. On the other hand, if the diameter of the first channel 1*b* is smaller than that of the jet opening downstream channel 5*b* of the known injector, fuel exhausted (injected) from the jet opening 1*a* will not be satisfactorily diffused, so that vaporization of fuel is impaired.

Thus, according to the first representative embodiment, the optimum diameter D1 of the first channel 1*b* for satisfactory performance of the above-mentioned both functions is provided so as to be substantially double the diameter D2 of the jet opening 1*a* over the entire region of the first channel 1*b*. Specifically, according to the first embodiment, the first channel is arranged to have a diameter of substantially 3.0 mm, while the jet opening is arranged to have a diameter of 1.5 mm. Also, according to the first representative embodiment, the optimum length of the first channel 1*b* in its axial direction (right and left in FIG. 1(*a*)) is provided so as to be substantially the same as or 1arger than the diameter D1 of the first channel. As a result, noise leakage to the outside can effectively be alleviated.

The second channel 1*c* is continuously and smoothly connected to the first channel 1*b* such that the first and second channel 1*b*, 1*c* define the jet opening downstream channel. The second channel 1*c* is conically enlarged away from the jet opening 1*a* such that fuel can be satisfactorily diffused by passing through the conically shaped second channel 1*c*.

A second representative embodiment of the invention will now be described in reference to FIG. 1(*b*). FIG. 1(*b*) is a sectional view of a valve seat of the second representative fuel injector. As shown in FIG. 1(*b*), a jet opening downstream channel 2*c* is provided to extend downstream from the jet opening 2*a* within the valve seat 2 and to communicate the jet opening 2*a* to the outside through the valve seat 2. The diameter of the jet opening downstream channel 2*c* is substantially double the diameter of the jet opening 2*a* over the entire region of the jet opening downstream channel 2*c*. As a result, relatively larger wall thickness C of the valve seat 2 can be ensured over the entire region of the jet opening downstream channel 2*c*, so that leakage of noise to the outside can be alleviated.

A third representative embodiment of the invention will now be described in reference to FIG. 1(*c*). FIG. 1(*c*) is a sectional view of a valve seat according to the third representative fuel injector. As shown in FIG. 1(*c*), a jet opening downstream channel is defined by first and second channel 3*b*, 3*c*. The first channel 3*b* is provided in a region right below the jet opening 3*a* to extend from the jet opening 3*a* within the valve seat 3 and to communicate the jet opening 3*a* to the second channel 3*c*. On the other hand, the second channel 3*c* is provided in a region right below the first channel 3*b* to extend from the first channel 3*b* within the valve seat 3 and to communicate the second channel 3*b* to the outside through the valve seat 3.

The diameter of the first channel 3*b* is substantially double the diameter of the jet opening 3*a* over the entire region of the first channel 3*b*. As a result, relatively larger wall thickness of the valve seat 3 can be ensured over the entire region of the first channel 3*b* such that leakage of noise to the outside can be alleviated. Further, the diameter of the second channel 3*c* is larger than that of the first channel 3*b* over the entire region of the second channel 3*c* so that satisfactory diffusion of fuel can be ensured.

What we claim is:

1. A fuel injector comprising:

a fuel passage, a valve disposed on the fuel passage, a valve seat that receives the valve, a jet opening having a diameter D2, the jet opening is formed in the valve seat and through which fuel is exhausted, the jet opening being opened when the valve is moved apart from the valve seat, and a jet opening downstream channel having a diameter D1 and extending downstream from the jet opening through the valve seat and communicates the jet opening to the outside, wherein the diameter D1 of the jet opening downstream channel is double the diameter D2 of the jet opening at least in a region right below the jet opening, a first channel and a second channel within the jet opening downstream channel, wherein the second channel is downstream said first channel and is continuously and smoothly connected to the first channel, said first channel has a constant diameter, while the second channel is conically enlarged away from the jet opening, and wherein the diameter D1 of the jet opening downstream channel being arranged and adapted such that the valve seat has a wall thickness to prevent leakage of noise to the outside through the valve seat, which noise is caused by contact of the valve with the valve seat.

2. The fuel injector as set forth in claim 1, wherein:

the diameter of the jet opening downstream channel is designed so as to ensure the diffusability of the fuel exhausted from the jet opening.

3. A fuel injector comprising:

a fuel passage, a valve disposed on the fuel passage, a valve seat that receives the valve, a jet opening having a diameter D2, the jet opening is formed in the valve seat and through which fuel is exhausted, the jet opening being opened when the valve is moved apart from the valve seat, and a jet opening downstream channel having a diameter D1 and extending downstream from the jet opening through the valve seat and communicates the jet opening to the outside, wherein the diameter D1 of the jet opening downstream channel is double the diameter D2 of the jet opening at least in a region right below the jet opening, a first channel and a second channel within the jet opening downstream channel, wherein the second channel is downstream said first channel and is continuously and smoothly connected to the first channel, said first channel has a constant diameter, while the second channel is conically enlarged away from the jet opening, and wherein the jet opening downstream channel defining means for providing a wall thickness of the valve seat so as to prevent leakage of noise to the outside through the valve seat, which noise is caused by contact of the valve with the valve seat.

* * * * *